United States Patent [19]

Davies

[11] 4,081,644

[45] Mar. 28, 1978

[54] ELECTRICAL CONTACT MATERIAL

[75] Inventor: Terrence Ardern Davies, Encino, Calif.

[73] Assignee: Plessey Handel Investments A.G., England

[21] Appl. No.: 621,241

[22] Filed: Oct. 9, 1975

Related U.S. Application Data

[63] Continuation-in-part of Ser. No. 373,594, Jun. 25, 1973, abandoned.

[30] Foreign Application Priority Data

Jun. 29, 1972 United Kingdom ..... 30461/72

[51] Int. Cl.[2] ..... H01H 1/02

[52] U.S. Cl. ..... 200/266; 75/134 V; 75/165; 75/172 R; 200/265

[58] Field of Search ..... 75/134 V, 165, 172 E, 75/172 G, 172 R, 173 R; 200/262, 264, 265, 266

[56] References Cited

U.S. PATENT DOCUMENTS

| | | | |
|---|---|---|---|
| 1,731,210 | 10/1929 | Davignon | 75/165 |
| 2,288,122 | 6/1942 | Cox | 75/173 R X |
| 2,300,286 | 10/1942 | Gwyn, Jr. | 200/266 X |

OTHER PUBLICATIONS

Hansen, "Constitution of Binary Alloys", 2nd ed. McGraw-Hill, 1958, p. 212.

Jedynak, "Where the (Switch) Action Is", IEEE Spectrum, Oct., 1973, pp. 56-62.

*Primary Examiner*—J. V. Truhe

*Assistant Examiner*—N.D. Herkamp

*Attorney, Agent, or Firm*—Scrivener, Parker, Scrivener & Clarke

[57] ABSTRACT

An electrical contact material which consists of at least one material selected from a first group which comprises any one of the precious metals, gold, palladium, ruthenium, rhodium and rhenium or their alloys and the silver/palladium series of contact alloys; and not more than three weight percent of at least one material selected from a second group which comprises lithium, sodium, sodium chloride, potassium compounds, rubidium, caesium and cadmium sulphide spread uniformly throughout, or formed at discrete sites at the surface of, the said at least one material of the first group.

14 Claims, No Drawings

ELECTRICAL CONTACT MATERIAL

This application is a Continuation-in-Part of application Ser. No. 373,594, filed June 25, 1973, now abandoned.

The invention relates to an electrical contact material.

For the purpose of this specification silver is not to be considered as a precious metal.

The invention provides an electrical contact material which consists of at least one material selected from a first group which comprises any one of the precious metals, gold, palladium, ruthenium, rhodium and rhenium or their alloys and the silver/palladium series of contact alloys; and not more than three weight percent of at least one material selected from a second group which comprises lithium, sodium, sodium chloride, potassium compounds, rubidium, caesium and cadmium sulphide spread uniformly throughout, or formed at discrete sites at the surface of, the said at least one material of the first group.

The foregoing and the other features according to the invention will be better understood from the following description of specific embodiments of the invention.

The electrical contact material according to the invention which is especially adapted for electrical contacts used in current switching circuits where the value of the current being switched can range from a few milliamperes right up to thousands of amperes, consists of a material having an electronic work function of the order of 4.4 to 4.6 eV and not more than three weight percent of a material having an electronic work function in the range 1.5 to 2.5 eV spread uniformly throughout, or formed at discrete sites at the surface of, the high electronic work function material.

The high electronic work function material used for the bulk of the contact material should be provided by at least one of the materials selected from the group which comprises any one of the precious metals i.e. gold, palladium, ruthenium, platinum, rhodium and rhenium or their alloys and the silver/palladium series of contact alloys.

The low electronic work function material should be provided by at least one of the materials selected from the group which comprises lithium, sodium, sodium chloride, potassium, rubidium, caesium, cadmium sulphide and compounds thereof. The amount of low electronic work function material which is present in the contact material should preferably be in the range 0.1 to 0.25 weight percent.

The high electronic work function materials previously referred to all possess an acceptable combination of those properties normally required for conventional contact materials, for example good thermal and electrical conductivities, low surface resistivity, high specific heat, good resistance to welding, good resistance to arc and bridge erosion processes, and good resistance to tarnish and corrosion, and are therefore ideally suited as the bulk constituent for the contact material according to the invention.

The low electronic work function materials previously referred to which should be formed at discrete sites at the surface of, or dispersed uniformly throughout the surface and throughout the bulk of, the high electronic work function material, can be added either singly or in combination to the bulk material and will cause a reduction in the electronic work function of the contact material at discrete sites within, or at the surface of, the material and thus spread arc erosion when contact is established between electrical contacts made from this material, reduce the electron energy in the arc which occurs when contact between the electrical contacts is broken, and effect weld embrittlement i.e. contribute to the breaking of the welds which form when contact is established between the electrical contacts.

The electrical contact materials according to the invention can be produced by any appropriate known technique, for example vacuum melting, powder metallurgy techniques, sputtering, evaporation, plasma spraying, ion implantation or electroplating under strictly controlled conditions from certain electrolytes, for example cyanide or sulphite solutions.

The electrical contact materials according to the invention are especially valuable but not exclusively so when used for electrical contacts which are employed in switching a capacitive load, or in fact any load where a discharge occurs on contact closure.

When pure materials, or alloys comprising elements of similar electronic work functions are used for the electrical contacts employed in these switching applications, the discharges resulting from contact closure occur between those points which protrude most out of the contact surfaces of the contacts, the actual position of any one discharge being controlled largely by the topography of the cathode contact. The actual initiation of the discharge involves field emission of electrons from the protrusions as the contacts close. The protrusions severely distort the electric field in their vicinity and cause the value of the electric field to be increased to a value which causes emission of electrons. Since each discharge damages and roughens the contact surfaces in the region where it occurs, thus giving rise to additional high protrusions in that region, it is highly likely that subsequent discharges will originate in the same region thereby causing excessive erosion in the case of A.C. switching application and material transfer in the case of D.C. switching application, the latter giving rise to pip and crater formation which will result in the contacts locking together.

This concentration of erosion in a region of the contact surface is prevented by the electrical contact material according to the invention in that the low electronic work function material provides an alternative mechanism for arc discharge initiation since electrons are emitted far more easily i.e. at low electric field strength, by low electronic work function materials than high electronic work function materials. The sites of low electronic work function material in the bulk of, or at the surface of, the contact material therefore act in exactly the same manner with regard to electron emission as do the protrusions of the pure materials or alloys. These two processes will, therefore, compete with each other during contact service. In practice, the highest protrusion which contains a site of low electronic work function material will provide the electrons for arc initiation. The resulting discharge destroys the original shape of the protrusion and roughens the area surrounding it, but the site of the low electronic work function material is completely destroyed and removed. Thus the following discharge is initiated from the next highest protrusion to contain a site of low electronic work function material, and so on. Hence, since the low work function material is well distributed, the erosion is well spread over the contact surfaces and as these are removed is then well spread throughout the bulk of the contact material instead of, as with known materials, being undesirably concentrated in one region.

In addition, these same low work function materials all tend to be ionised very easily in electrical discharges and are readily raised to excited optical states resulting subsequently in the emission of light quanta. Each possesses one or more of the following desirable parameters: low ionisation potential, low excitation potentials, high electronic cross-section for ionisation, steeply rising excitation functions and high cross-sections for electronic excitation. The addition of such materials to contacts thus vastly increases the tendency for inelastic collisions by electrons to occur in arcs drawn between them causing a significant reduction in mean electron energy and in the relative number of electrons with high energies. Thus the electronic bombardment of the contacts becomes less severe resulting in less heating and leading to less volatilisation and erosion. This beneficial effect occurs both for arcs drawn on contact closure and for those on contact opening.

A typical material according to the invention which can be used for the electrical contacts of reed relays, or the electrical contacts of conventional open and hermetically sealed relays where the contacts switch up to 100 mA D.C. at open circuit voltages of up to 50 volts, would consist of a mixture of gold which has an electronic work function of 4.6 eV, and a potassium compound which has a lower electronic work function than the gold, well distributed throughout the gold. Electrical contact materials of this composition can be produced by electroplating from a suitably buffered gold-/potassium electrolyte onto a substrate of a material such as a nickel/iron alloy, the potassium being present as an occluded potassium compound, for example a potassium/gold/cyanide compound, a potassium/-gold/phosphate compound, a potassium/gold/citrate compound, or derivatives thereof, the actual compound that will be present being dependent upon the material on which the gold/potassium electrolyte is based. A typical nickel/iron alloy for this purpose would contain 51% nickel and 49% iron.

These electroplated electrical contact materials often include an additional material such as a cobalt or a nickel complex in order to provide hardening of the final electroplated deposit.

The electroplating of gold/potassium compound electrical contact materials containing a cobalt-EDTA hardening complex onto say a nickel/iron substrate can be effected from a gold/potassium cyanide electrolyte (12.5 grams/liter) buffered with potassium di-hydrogen phosphate (96.0 grams/liter) and citric acid (24.0 grams/liter) and containing the cobalt-EDTA complex to provide the hardening of the final deposit. Gold based contact material deposits produced from this electrolyte are given below together with the electroplating parameters and the topography of the deposits.

| Example | 1 | 2 | 3 | 4 | 5 |
|---|---|---|---|---|---|
| Amount of Cobalt Complex in solution (grams/litre) | 3.5 | 1.0 | 1.0 | 1.0 | 1.0 |
| Potassium content of deposit (weight percent) | 0.07 | 0.03 | 0.21 | 0.18 | 0.17 |
| Cobalt content of deposit (weight percent) | 0.25 | 0.25 | 0.25 | 0.25 | 0.25 |
| pH of electrolyte | 4.2 | percent) | 3.4 | 4.2 | 5.0 |
| Plating temperature (° C) | 25 | 35 | 25 | 25 | 25 |
| Plating current density (mA/cm$^2$) | 2.5 | 7.5 | 50 | 20 | 7.5 |
| Topography of deposit | Smooth | Smooth | Smooth | Smooth | Rough and Fibrous |

It was found that the lateral spread of contact material erosion with the gold based contact materials according to examples 1 and 2 was not very great, and that there was no spread of erosion with the material according to example 5 because the work function effect is swamped by the topography of the deposit. However, the gold based contact materials according to examples 3 and 4 were such that contact erosion was reduced and spread laterally over the entire contact surface during use.

Alternatively, the electroplating of gold/potassium compound electrical contact materials containing a hardening complex of nickel can be effected from a gold/potassium cyanide electrolyte (9.0 grams/liter), buffered with citrate and containing 4.0 grams/liter of the complex of nickel to harden the deposit. Gold based contact material deposits produced from this electrolyte are given below together with the electroplating parameters and the topography of the deposits:

| Example | 6 | 7 | 8 |
|---|---|---|---|
| Potassium content of deposit (weight percent) | 0.06 | 0.15 | 0.01 |
| Nickel content of deposit (weight percent) | 0.4 | 0.4 | 0.4 |
| Plating current density (mA/cm$^2$) | 7.5 | 20 | 50 |
| Topography of deposit | Smooth | Smooth | Smooth |

The electroplating of the materials according to examples 6 to 8 was effected at a temperature of 30° C and a pH of 4.4.

It was found that the lateral spread of contact material erosion with the gold based contact material according to example 6 was not very great and that there was no spread of erosion with the material according to example 8. The gold based contact material according to example 7 did, however, exhibit good contact erosion characteristics in that the erosion was reduced and spread laterally over the entire contact surface during use.

It can, therefore, be seen from the foregoing that in order to provide a reduction in contact erosion and a lateral spread of the erosion over the entire contact surface during use, the electroplated gold/potassium compound electrical contact material deposits must have a high potassium compound concentration i.e. of not less than 0.1 weight percent and a smooth surface finish i.e. surface deviations of not greater than 0.1 microns.

Another electrical contact material according to the invention which can be used for electrical contacts utilised to switch a capacitive load, would consist of a mixture of gold, not greater than 0.06 weight percent of a potassium compound well distributed throughout the gold and 0.15 weight percent of sodium chloride formed at discrete sites at the surface of the material.

This gold/potassium compound/ sodium chloride electrical contact material can be produced by a method which includes the step of electroplating a gold/potassium compound composite onto a substrate of a material such as a nickel/iron alloy from a commercially available nickel-containing gold/potassium cyanide electrolyte known as Aurall 177. This electroplated electrical contact material deposit would, therefore, contain a nickel hardener to a concentration of approximately 0.4 weight percent.

The gold/potassium compound deposit is then boiled for 10 minutes in a saturated sodium chloride solution followed by a one minute rinse in de-ionised water. This process results in a uniform distribution of minute sodium salt crystals being formed over the surface of the deposit i.e. the contact surface of the deposit, the separation between crystals being at least 1.5 microns.

This gold/potassium/sodium chloride electrical contact material deposit containing a nickel hardener was such that contact erosion was reduced and spread laterally over the entire contact surface during use. The deposit was also capable of successfully completing $10^6$ operations switching a capacitive inrush current of one ampere at 50 volts D.C.

Any of the other low electronic work function materials previously referred to can also be combined as a compound with gold by the electroplating technique using suitable electrolytes, or using soluble complexes or salts of the elements concerned. Alternatively, these gold based materials can be produced by the occlusion plating of the solid compounds of the elements suspended in a suitable electrolyte.

The electrical contact materials according to the invention have the advantage that they provide a mechanism whereby contact erosion, and particularly arc erosion is both reduced and spread laterally over the entire contact surface during use, thus maximising the utilisation of the contact material involved and eliminating the undesirable tendency of conventional materials to pip and crater formation which eventually leads to contact locking and failure to break the established circuit.

It is to be understood that the foregoing description of specific examples of this invention is made by way of example only and is not to be considered as a limitation in its scope.

What is claimed is:

1. An electrical contact material which consists of at least one material selected from a first group which comprises any one of the precious metals, gold, palladium, ruthenium, rhodium and rhenium or their alloys and the silver/palladium series of contact alloys; and not more than three weight percent of at least one material selected from a second group which comprises occluded compounds of lithium, sodium, potassium, rubidium, caesium and cadmium, spread uniformly throughout, or formed at discrete sites at the surface of the at least one material of the first group, and a hardening metal when gold is combined with a compound of the second group.

2. An electrical contact formed of the material set forth in claim 1.

3. An electrical contact material according to claim 1 wherein the concentration of the said at least one material of the second group is in the range 0.01 to 0.25 weight percent.

4. An electrical contact formed of the material set forth in claim 3.

5. An electrical contact material as claimed in claim 1 which consists of a mixture of gold and a potassium compound.

6. An electrical contact formed of the material set forth in claim 5.

7. An electrical contact material as claimed in claim 5 wherein the potassium concentration is greater than 0.1 weight percent.

8. An electrical contact formed of the material set forth in claim 7.

9. An electrical contact material as claimed in claim 1 wherein the hardening metal is selected from a group which consists of cobalt and nickel.

10. An electrical contact formed of the material set forth in claim 9.

11. An electrical contact material as claimed in claim 1 which consists of a mixture of gold and at least one material selected from the second group.

12. An electrical contact formed of the material set forth in claim 11.

13. An electrical contact material which consists of a mixture of at least one material selected from a first group which comprises palladium, ruthenium, rhodium and rhenium or their alloys and the silver/palladium series of contact alloys; and not more than three weight percent of at least one material selected from a second group which comprises occluded compounds of lithium, sodium, potassium, rubidium, caesium and cadmium spread uniformly throughout, or formed at discrete sites at the surface of, the said at least one material of the first group.

14. An electrical contact formed of the material set forth in claim 13.

* * * * *